US010734699B2

(12) United States Patent
Sherwood et al.

(10) Patent No.: US 10,734,699 B2
(45) Date of Patent: Aug. 4, 2020

(54) ANTENNA MOUNT WITH MULTI-DIRECTIONAL FOOT ASSEMBLY

(71) Applicant: Winegard Company, Burlington, IA (US)

(72) Inventors: William John Sherwood, West Burlington, IA (US); Brian Steven Zihlman, Mt. Pleasant, IA (US)

(73) Assignee: Winegard Company, Burlington, IA (US)

( * ) Notice: Subject to any disclaimer, the term of this patent is extended or adjusted under 35 U.S.C. 154(b) by 101 days.

(21) Appl. No.: 16/168,197

(22) Filed: Oct. 23, 2018

(65) Prior Publication Data

US 2019/0123418 A1 Apr. 25, 2019

Related U.S. Application Data

(60) Provisional application No. 62/576,951, filed on Oct. 25, 2017.

(51) Int. Cl.

| | |
|---|---|
| ***H01Q 3/08*** | (2006.01) |
| ***H01Q 1/12*** | (2006.01) |
| ***H01Q 19/13*** | (2006.01) |
| ***H01Q 3/04*** | (2006.01) |

(52) U.S. Cl.

CPC ..... *H01Q 1/125* (2013.01); *H01Q 1/1221* (2013.01); *H01Q 3/04* (2013.01); *H01Q 3/08* (2013.01); *H01Q 19/13* (2013.01)

(58) Field of Classification Search

CPC ..... H01Q 1/125; H01Q 1/1221; H01Q 3/04; H01Q 3/08

See application file for complete search history.

(56) References Cited

U.S. PATENT DOCUMENTS

| | | | |
|---|---|---|---|
| D330,555 | S | 10/1992 | Lilly |
| 6,328,269 | B1 | 12/2001 | Krautloher |
| 6,361,007 | B1 | 3/2002 | Oby |
| D625,170 | S | 10/2010 | McGrath |
| 8,196,872 | B1 | 6/2012 | McGrath |
| 8,462,076 | B2 | 6/2013 | Fruh |
| 2007/0041727 | A1 | 2/2007 | Lee |
| 2008/0252553 | A1 | 10/2008 | Leadley-Brown |
| 2009/0154912 | A1 | 6/2009 | Lin |
| 2011/0187624 | A1 | 8/2011 | Lettkeman |
| 2012/0187276 | A1 | 7/2012 | Hudson |
| 2012/0211634 | A1 | 8/2012 | Yang |
| 2016/0312490 | A1 | 10/2016 | McDowell |

*Primary Examiner* — Graham P Smith

(74) *Attorney, Agent, or Firm* — W. Scott Carson

(57) ABSTRACT

An antenna mount (1) for a satellite dish (13) or other antenna having a plurality of legs (3,5,7). At least one leg (3) has a multi-directional foot assembly (11) adjustably securable to a support structure and a domed portion (21) with a slot (27) through it extending along an arcuate path that receives an attaching member (31). The domed portion is preferably surrounded by a portion (25) securable to the support structure. The one leg is then adjustably securable at one end to the attaching member and to the raised portion. The one leg is then securable at another end to a second leg or mast (7). With at least a section (7') of the second leg or mast preferably aligned vertically, the respective legs can be secured in place to the support structure and to each other with the antenna then attached to the upstanding, vertical mast section (7').

32 Claims, 19 Drawing Sheets

ANTENNA MOUNT WITH MULTI-DIRECTIONAL FOOT ASSEMBLY

RELATED APPLICATIONS

This application claims the benefit of U.S. Provisional Patent Application Ser. No. 62/576,951 filed Oct. 25, 2017, which is incorporated herein by reference.

BACKGROUND OF THE INVENTION

1. Field of the Invention

This invention relates to the field of antenna mounts and more particularly to the field of such mounts with adjustable feet securable to a variety of surfaces and structures.

2. Discussion of the Background

Antenna mounts are commonly used to support antennas on a wide variety of structures having a wide variety of shapes including flat and slanted roofs, walls, and parts of structures such a roof rafters. Some areas are relatively easy to access for installations such as roofs but some are less accessible and often cramped such as in an attic. In all cases, it is advantageous that the mount be relatively easy to install and avoid having any complicated installation instructions as well as complicated and often expensive parts. In virtually all cases, it is desirable that the antenna mount have a main mast with at least a section that can be supported in a vertical position to receive the antenna (e.g., satellite dish or over-the-air antenna) as most antennas are designed to be adjusted, calibrated, and operated based on being mounted and oriented in an initial, vertical position.

With this and other matters in mind, the present invention including its multi-directional foot assembly was developed. In it, the multi-directional foot assembly allows the antenna mount to be secured to a number of different support structures with a wide variety of shapes to position the antenna in the desired, initial vertical orientation for preferred installation and operation.

SUMMARY OF THE INVENTION

This invention involves an antenna mount for a satellite dish or other antenna to send or receive signals. The mount includes a plurality of legs with at least one of the legs having a multi-directional foot assembly adjustably securable to a number of different structures having a wide variety of shapes including flat and slanted roofs, walls, and parts of structures such a roof rafters. The foot assembly has a raised or domed portion with a slot through it extending along an arcuate path that receives a portion of an attaching member such as a carriage bolt. The raised or domed portion of the foot assembly is preferably surrounded by an annular, planar portion adjustably securable to the support structure in a number of fixed positions relative to it. One end portion of the one leg is then adjustably securable to the attaching member and to the raised portion of the foot assembly in a number of fixed positions relative to each other. The other end portion of the one leg in turn is adjustably securable to a second or mast leg of the antenna mount in a plurality of relative, fixed positions. In operation and with at least a section of the second or mast leg preferably aligned vertically, the respective legs at their feet can be secured in place to the support structure and secured at their other ends to each other with the antenna element then attached to the upstanding, vertical mast section.

DETAILED DESCRIPTION OF THE INVENTION

Figure 1A:
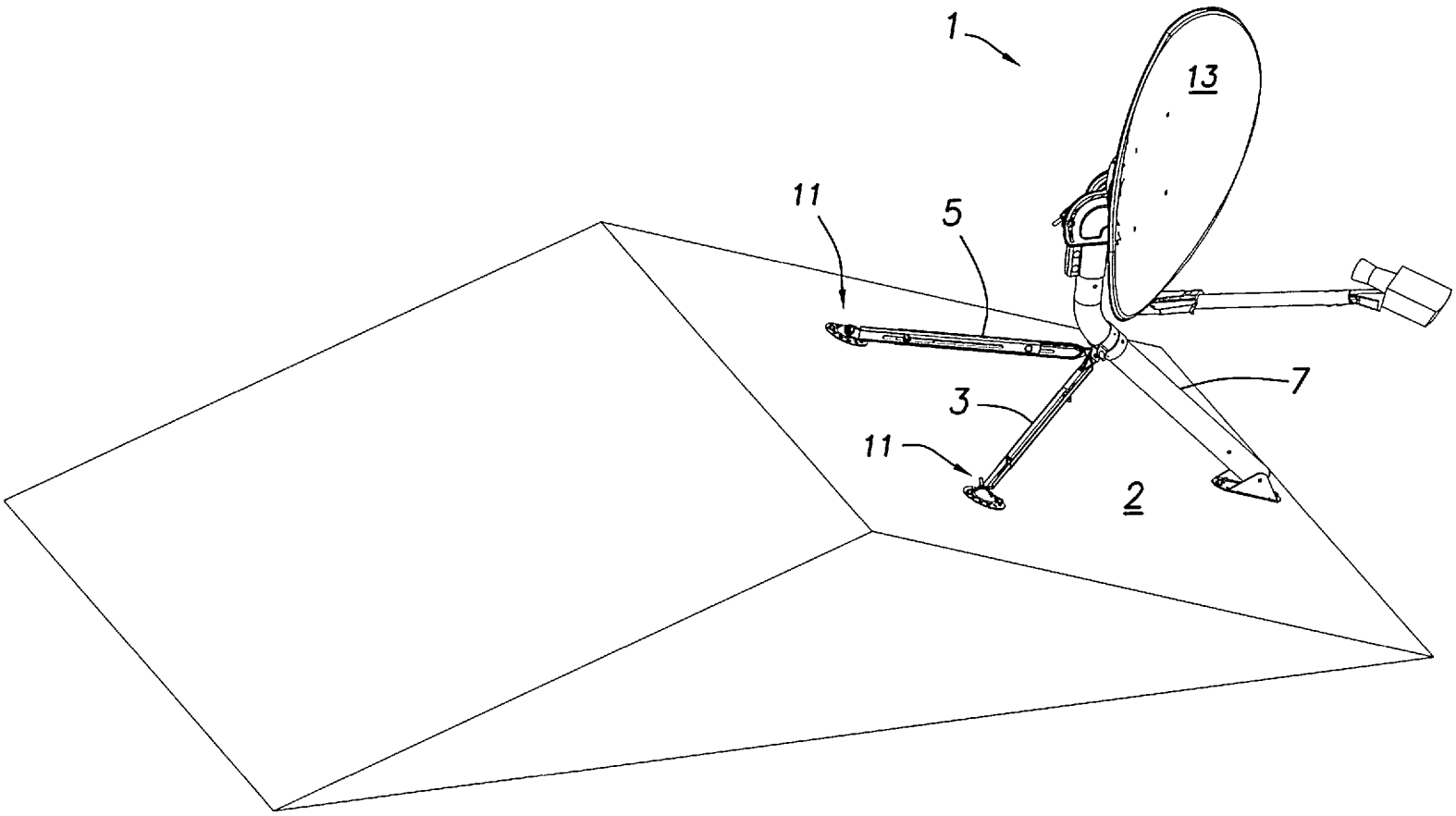
FIGS. 1*a*-1*e* are views of the antenna mount of the present invention positioned on an inclined or slanted roof.
Figure 1B:
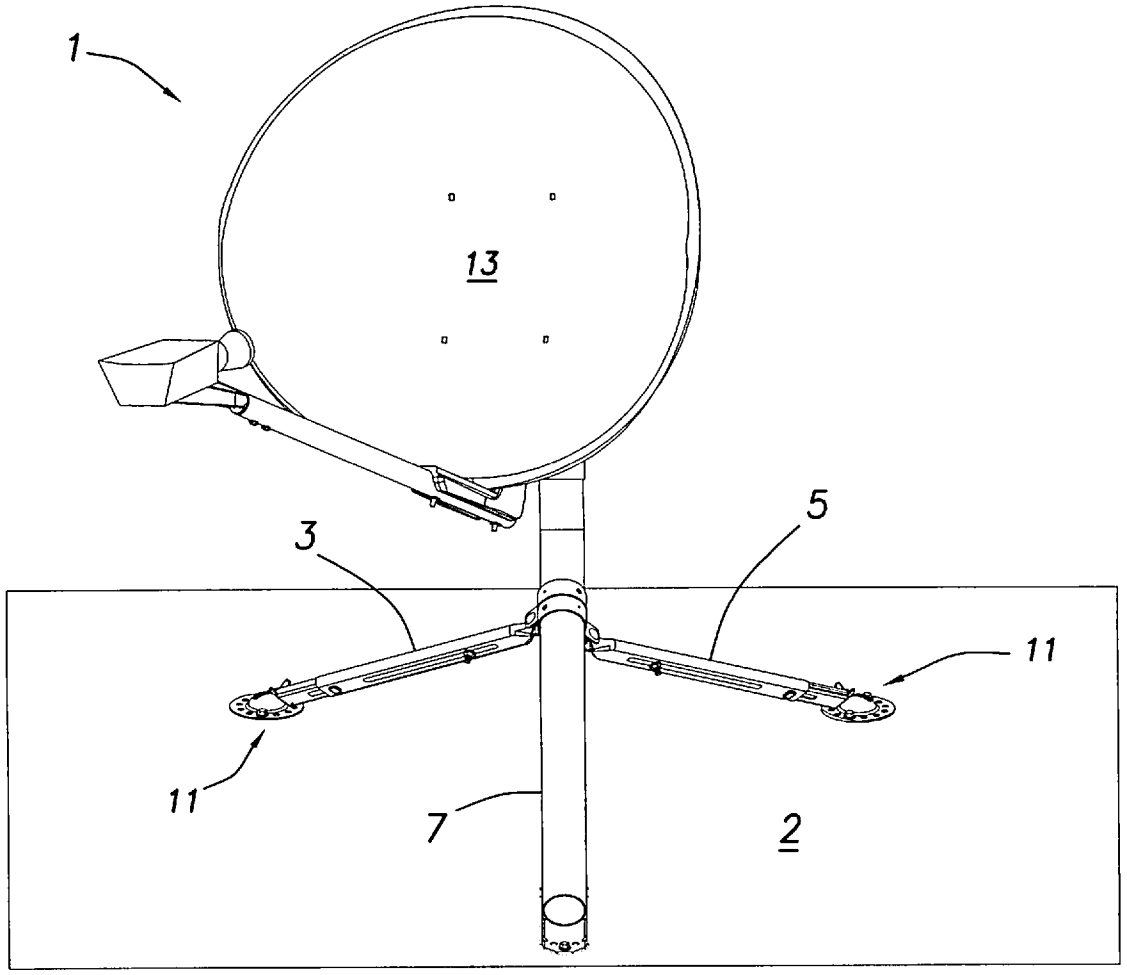
Figure 1C:
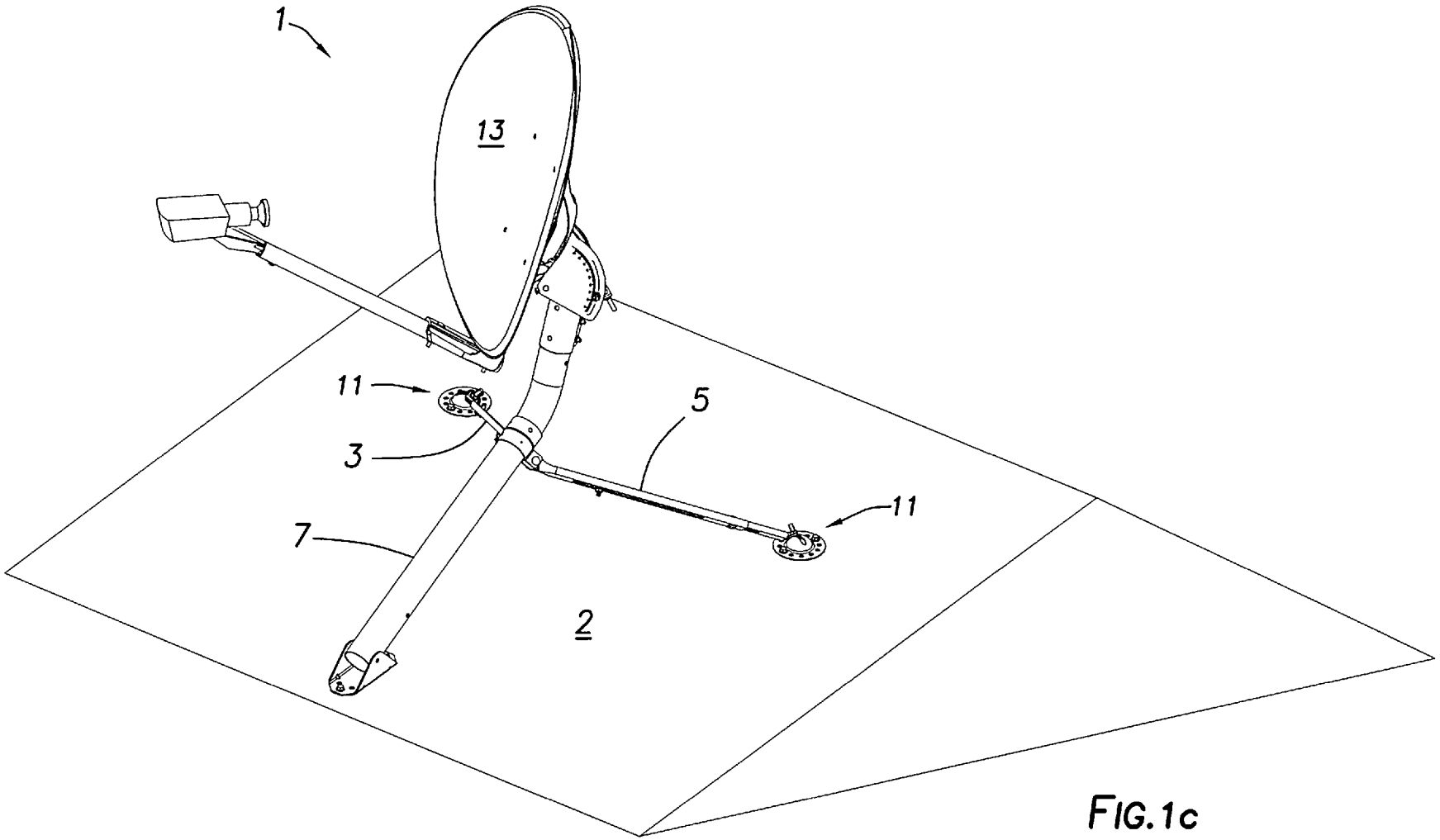
Figure 1D:
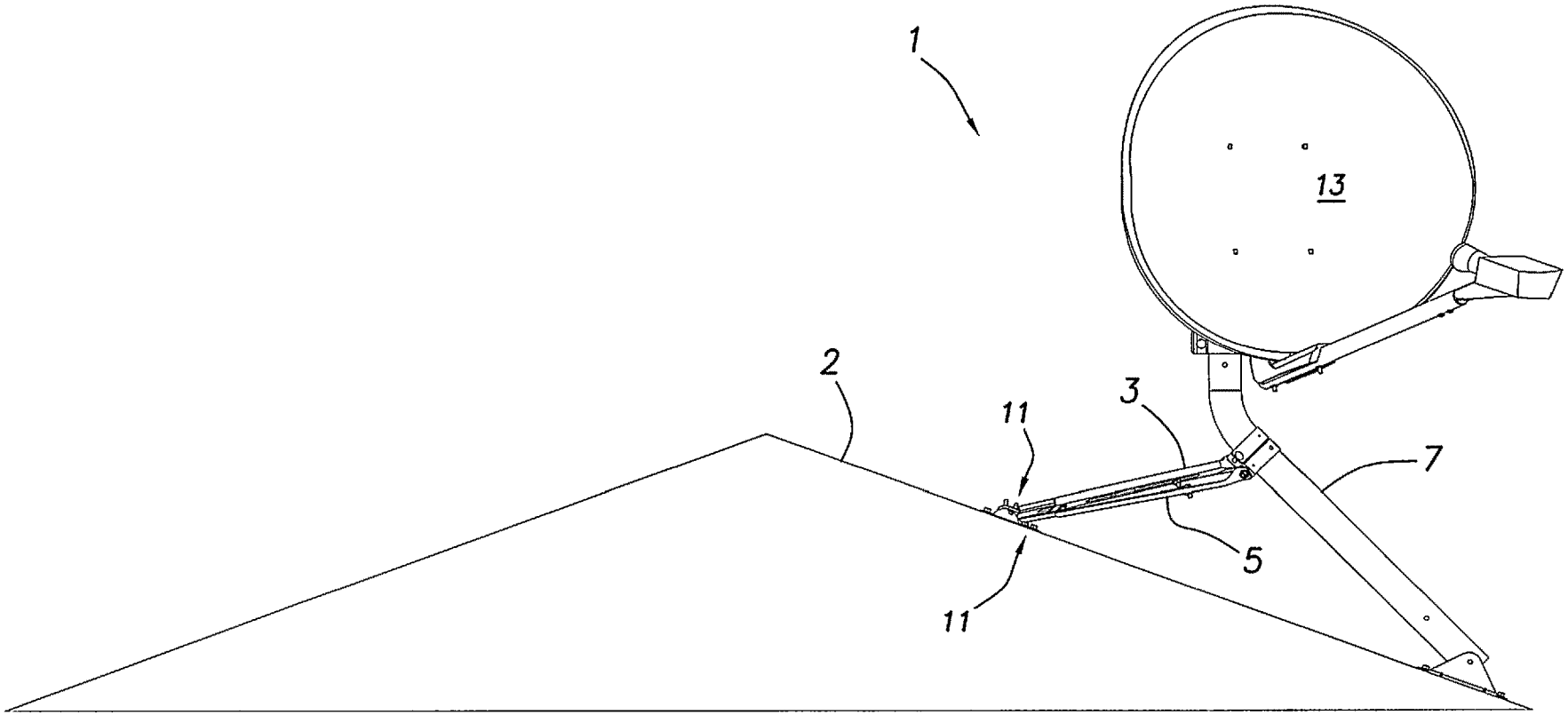
Figure 1E:
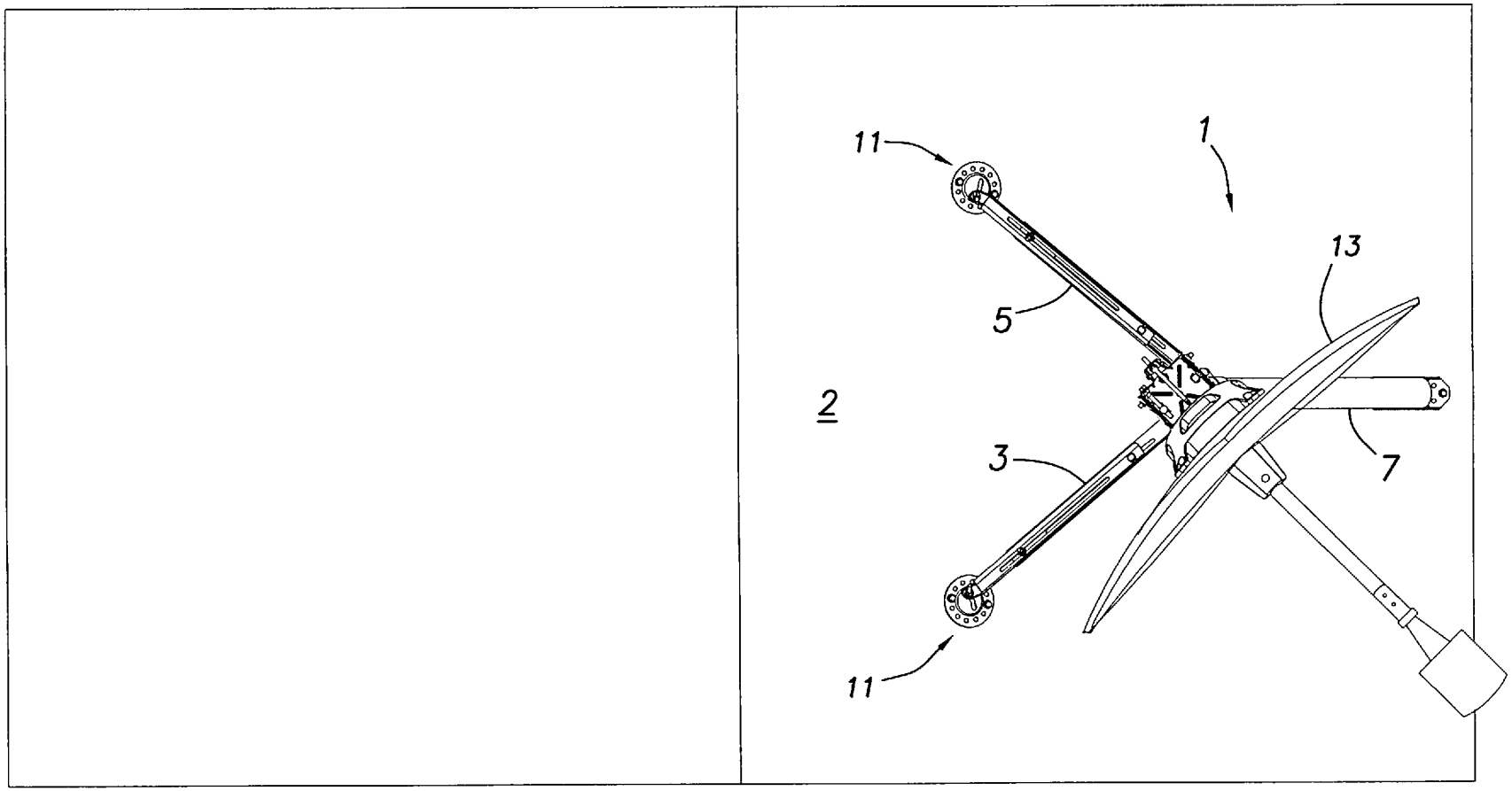
Figure 2A:
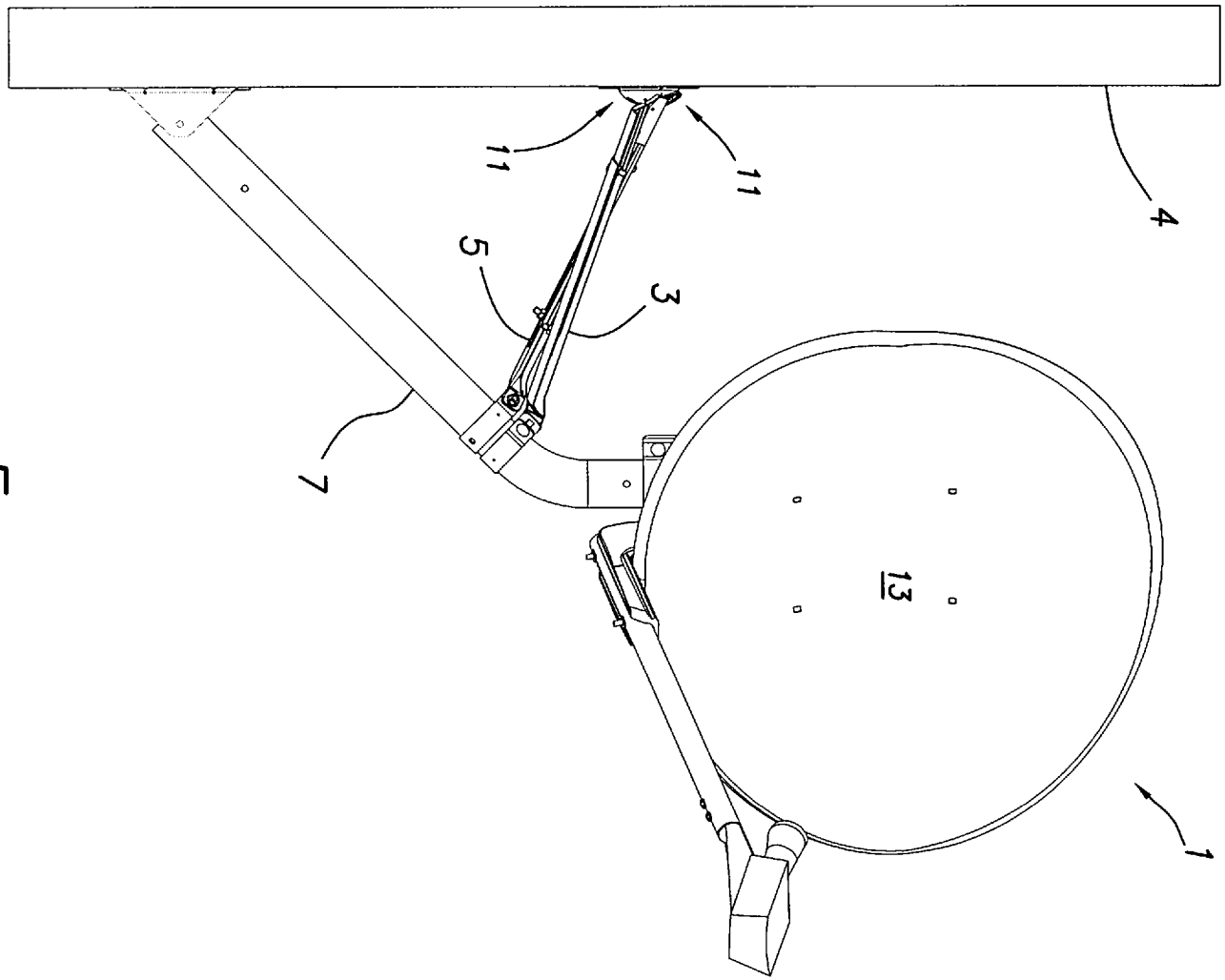
FIGS. 2*a*-2*c* are views of the antenna mount positioned on a vertical wall.
Figure 2B:
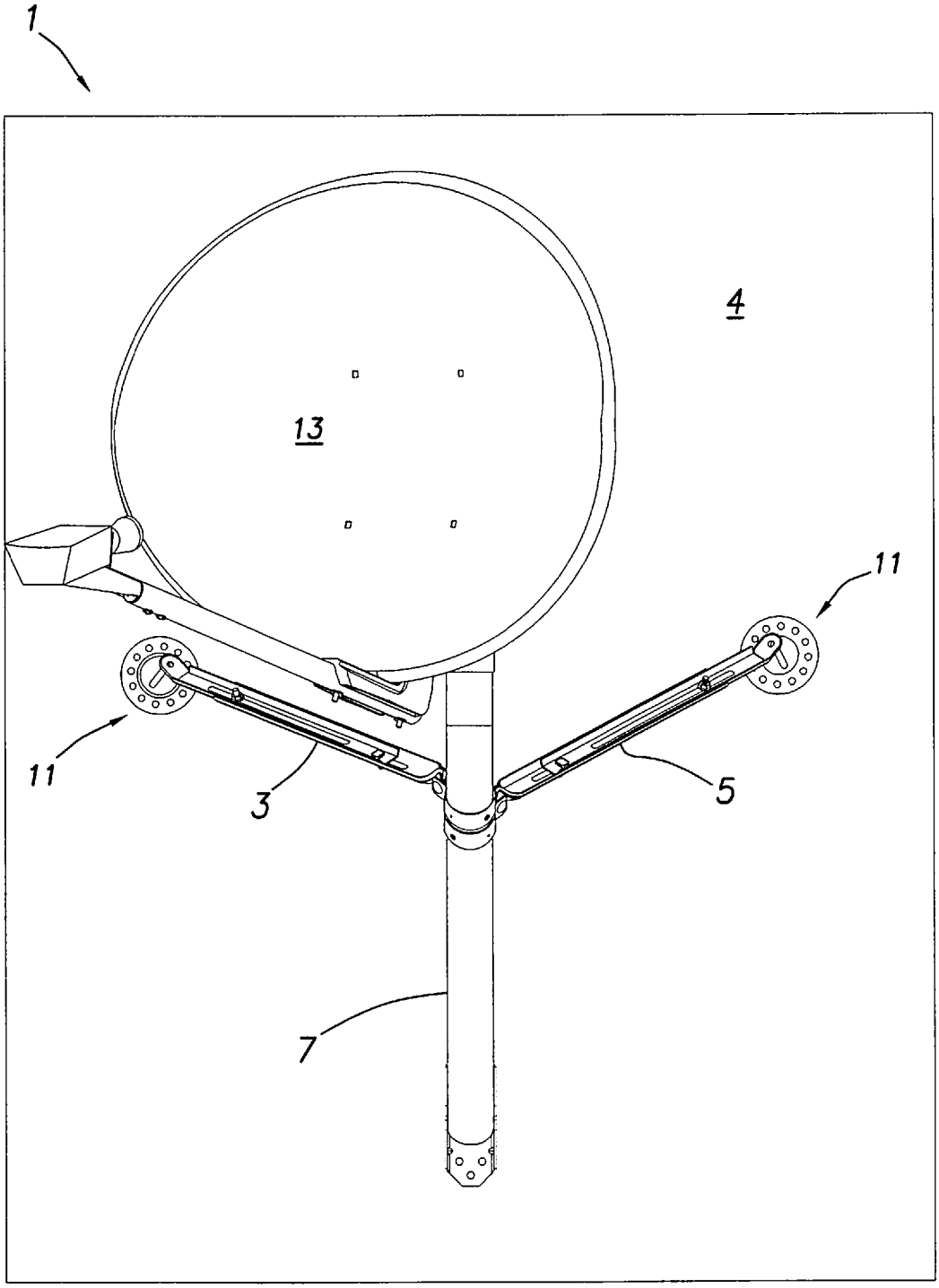
Figure 2C:
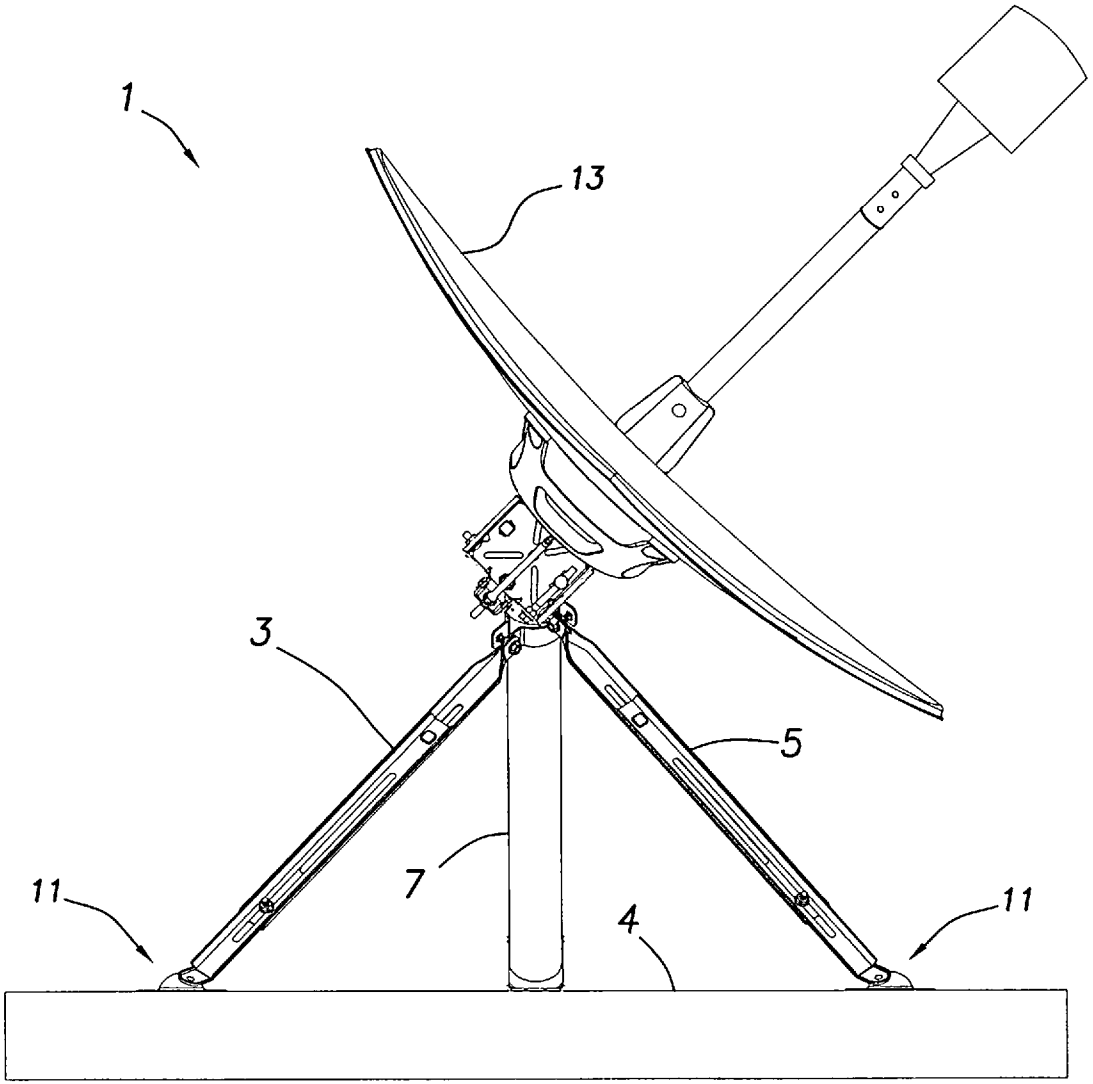

As shown in FIGS. 1*a*-1*e*, the antenna mount 1 of the present invention preferably includes a plurality of at least three legs 3,5,7. Two of the legs or struts 3,5 preferably have multi-directional foot assemblies 11 and the third leg 7 preferably is a conventional mast with the antenna element 13 attached (e.g., by bolts or clamps) to it. The antenna mount 1 as illustrated in FIGS. 1*a*-3*b* can be secured to a number of support structures including the inclined or slanted roof 2 of FIGS. 1*a*-1*e*, the vertical wall 4 of FIGS. 2*a*-2*c*, the horizontal roof rafters 6 of FIG. 3*a*, and the vertical wall studs 8 of FIG. 3*b*.

Figure 3B:
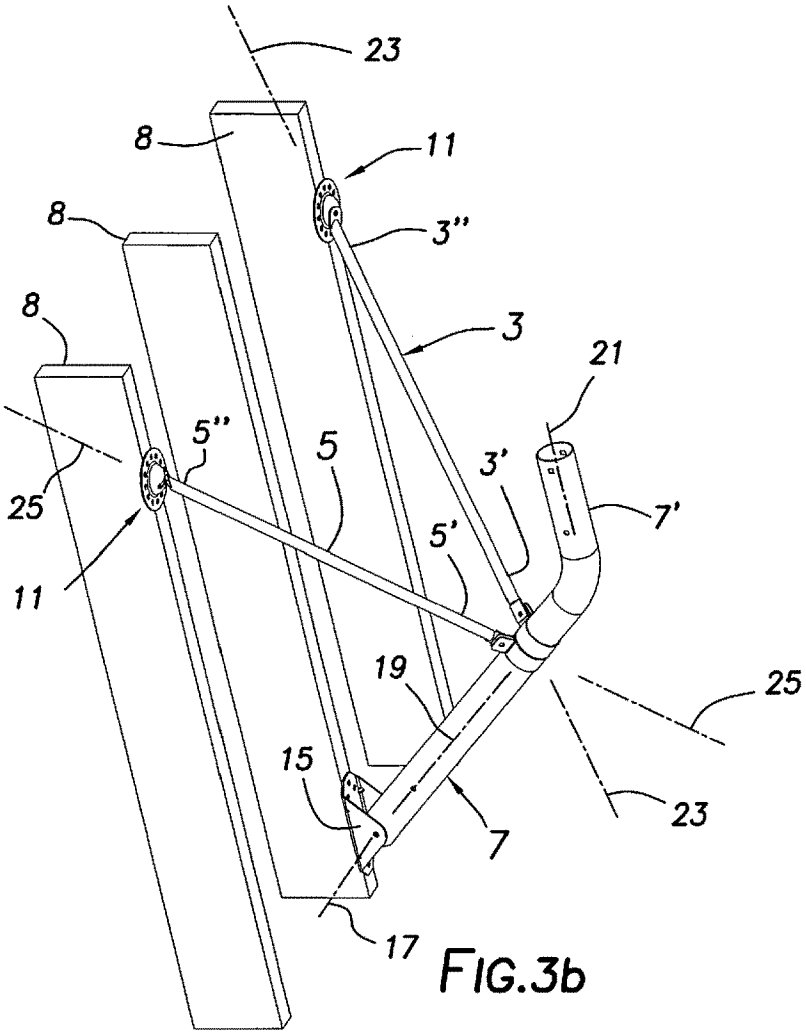
FIGS. 3*a*-3*b* are views of the antenna mount as positioned on roof rafters (FIG. 3*a*) and wall studs (FIG. 3*b*). The antenna element is not shown in these views for clarity.
Figure 3A:
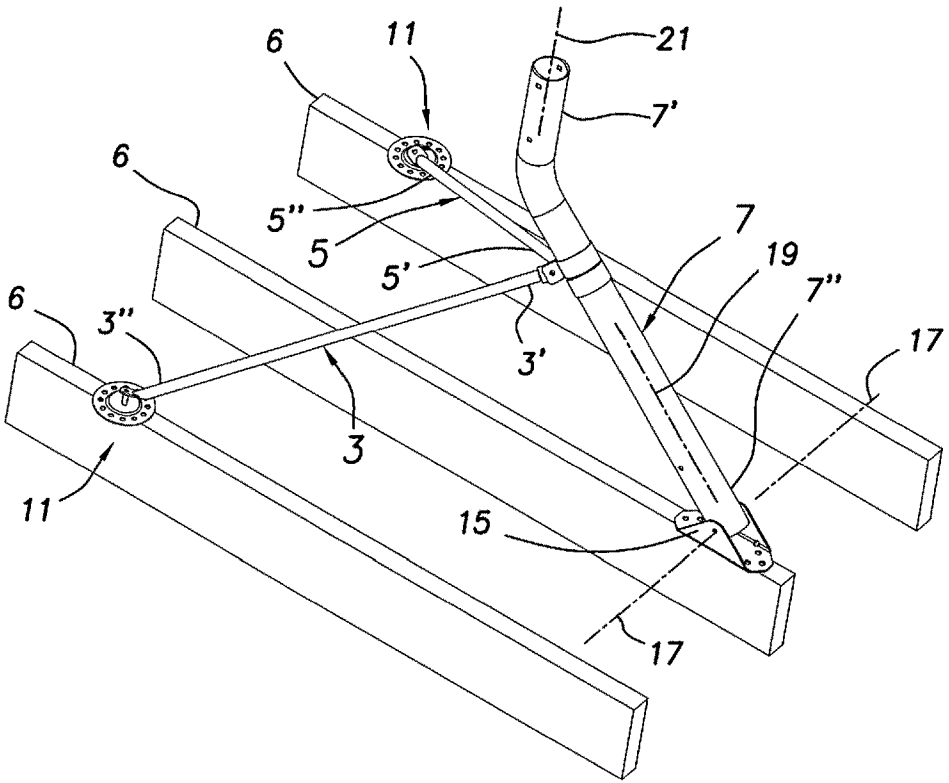

In one mode of installation as perhaps best seen in FIG. 3*a*, the mast or third leg 7 is preferably mounted at its lower section 7" by a mount 15 to the support structure (e.g., the middle roof rafter 6). The foot mount 15 for the mast leg 7 can be any one of a number of designs but preferably supports the mast or third leg 7 for pivotal movement about a substantially horizontal axis such as 17. The axes 19,21 of the upper and lower mast sections 7',7" are preferably inclined to one another and intersect (e.g., at 45 degrees). The axes 19,21 are also preferably movable with the mast leg 7 substantially in a vertical plane that is substantially perpendicular to the pivotal axis 17 and contains the axes 19,21. The upper mast section 7' and its axis 21 can then be positioned vertically to align the attached antenna element such as 13 of FIGS. 1*a*-2*c* in the desired, initial vertical orientation for preferred installation and operation.

With the antenna element 13 pre-attached or not to the upper section 7' of the mast leg 7 in FIG. 3*a* and with the upper section 7' aligned vertically, the other two legs 3,5 can then be manipulated to the positions of FIG. 3*a* and secured to the respective roof rafters 6 of the support structure and to the mast leg 7. In this manner as mentioned above, the upper mast section 7' of the mast leg 7 is then rigidly fixed in the preferred vertical alignment as is the antenna element 13 once it is secured to the upper mast section 7'.

In this regard and as perhaps best seen in the wall mounted embodiment of FIG. 3*b*, each of the legs or struts 3,5 extends along a respective axis 23,25 between first and second end portions 3',3" and 5',5". The respective first end portions 3',5' are adjustably securable to the third or mast leg 7. The respective second end portions 3",5" are then adjustably securable to a respective multi-directional foot assembly 11 that in turn is adjustably securable to a support structure such as the roof rafters 6 in FIG. 3*a* and wall studs 8 in FIG. 3*b*.

Figure 4A:
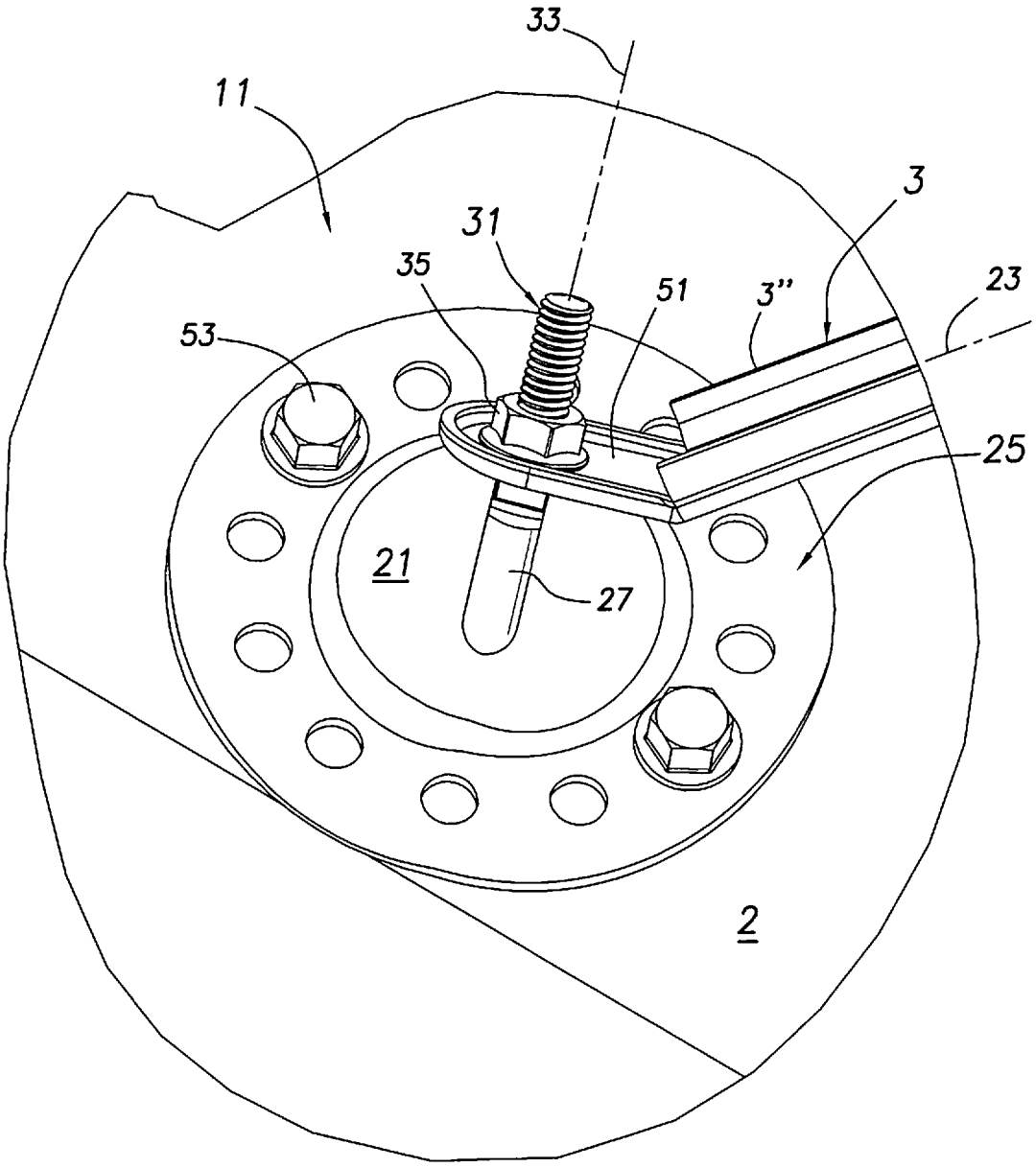
FIG. 4*a* is an enlarged view of the multi-directional foot assembly of one of the legs of the antenna mount as secured to a support structure such as the ones of FIGS. 1*a*-1*e* and 2*a*-3*b*.
Figure 4B:
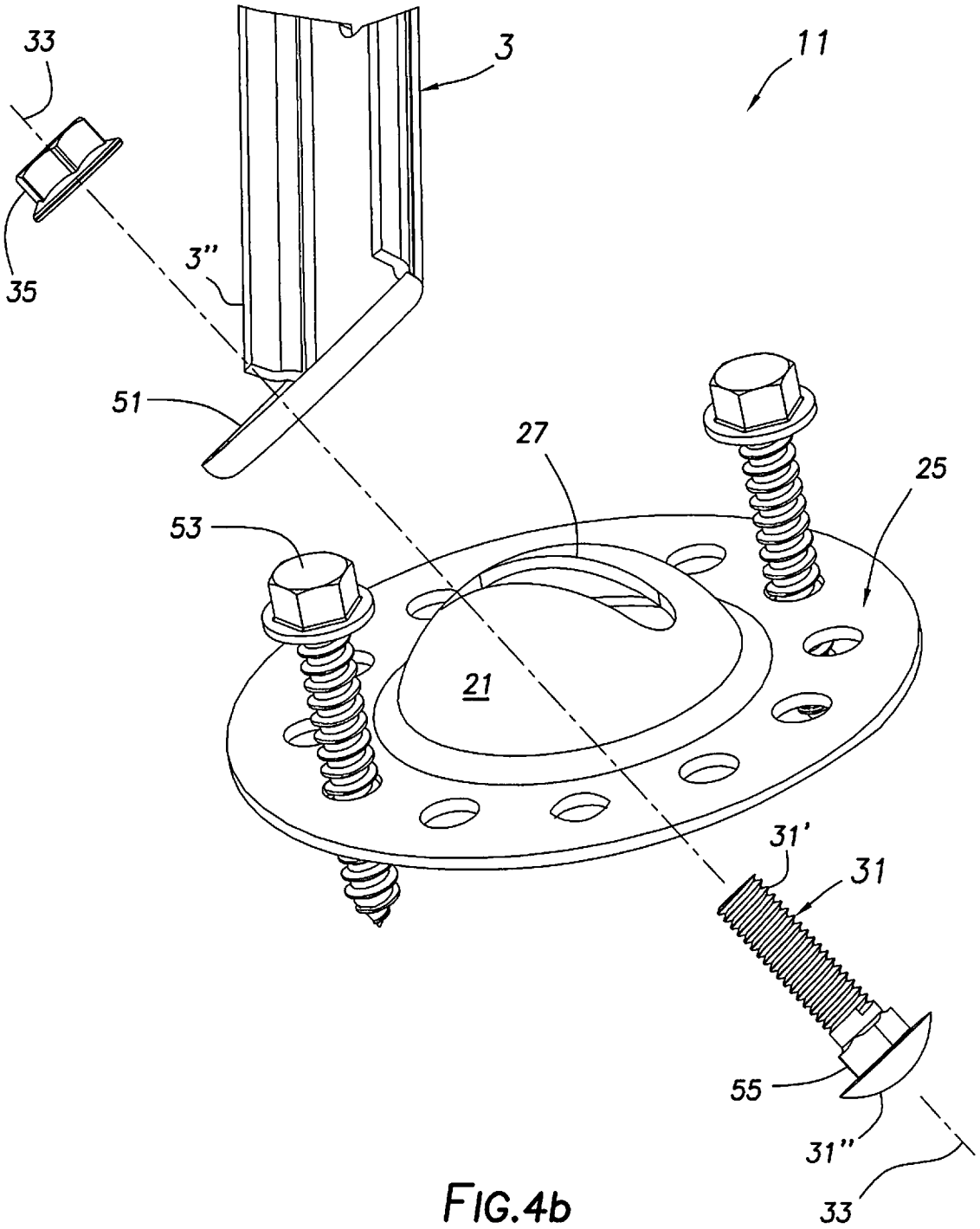
FIG. 4*b* is an exploded view of the foot assembly of FIG. 4*a*.
Figure 5A:
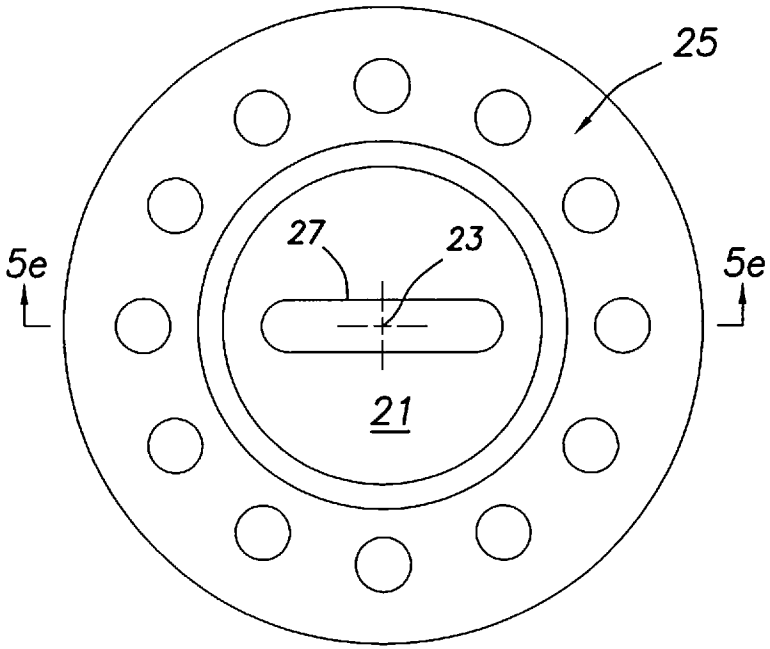
FIGS. 5*a*-5*f* are views of the raised or dome-shaped portion of the preferred embodiment of the foot assembly and the annular, planar portion surrounding it.
Figure 5B:
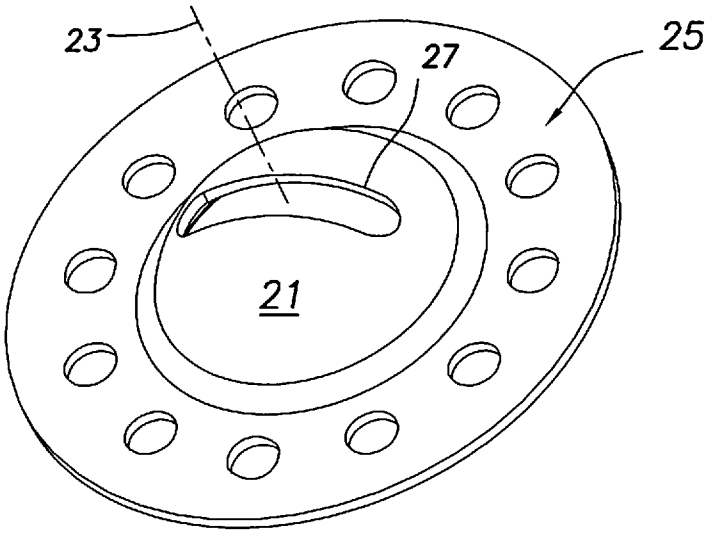
Figure 5C:
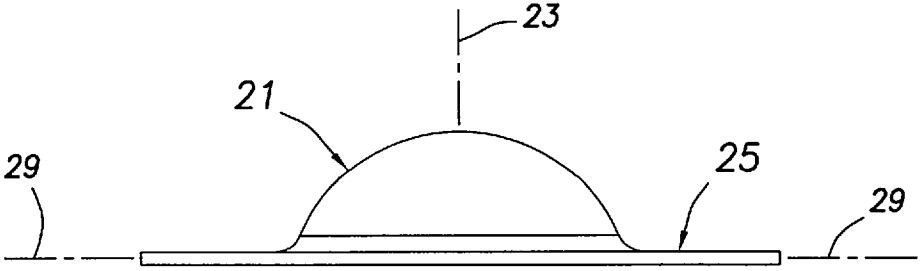
Figure 5D:
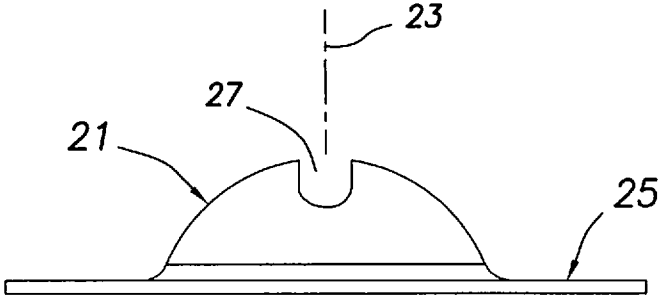
Figure 5E:
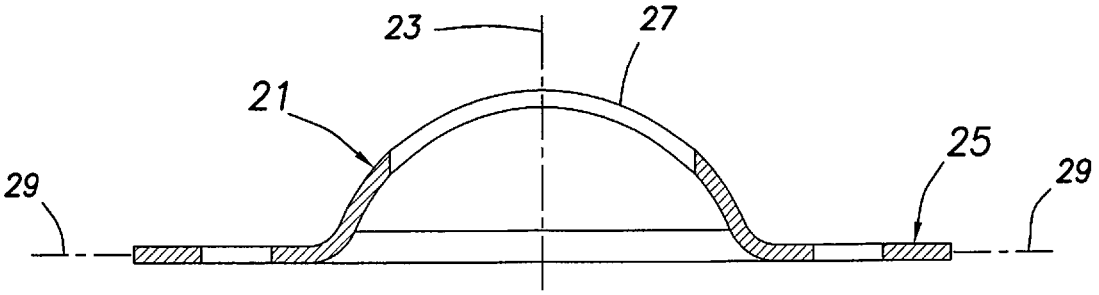
Figure 5F:
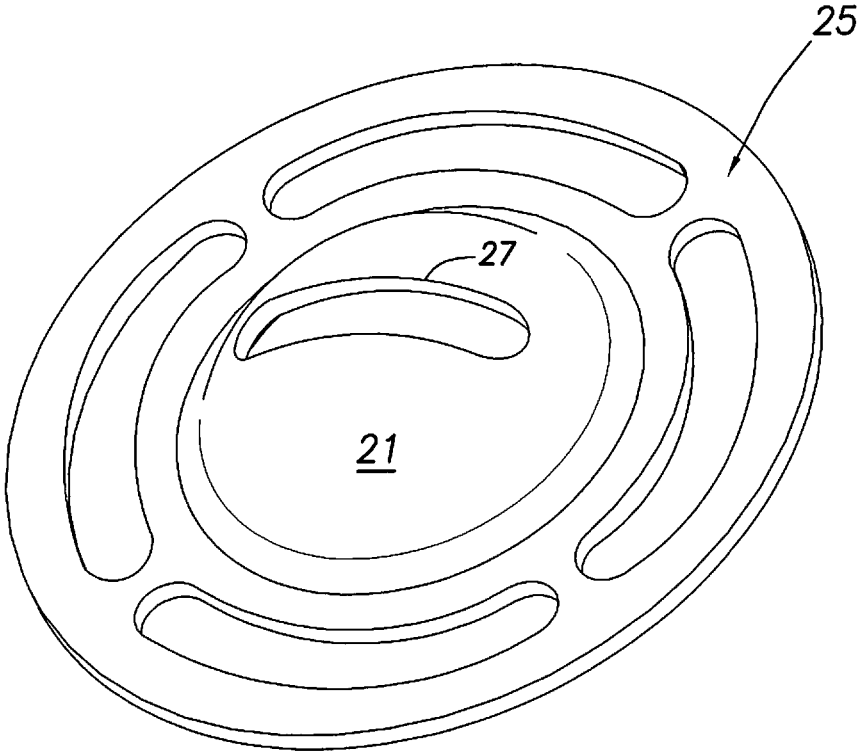
Figure 6B:
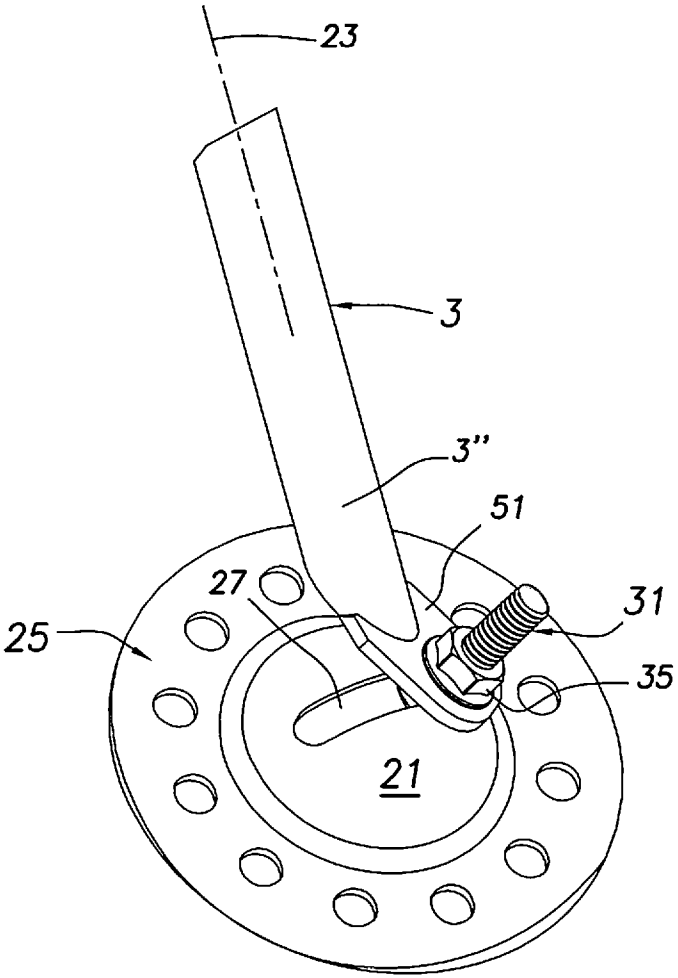
FIGS. 6*a*-6*f* further illustrate the foot assembly and schematically indicate by the arrows in FIGS. 6*a* and 6*c* the wide range of adjustability of the foot assembly about multiple axes to accommodate a wide variety of support structures and shapes including the slanted roof, vertical wall, roof rafters, and wall studs of FIGS. 1*a*-3*b*.
Figure 6A:
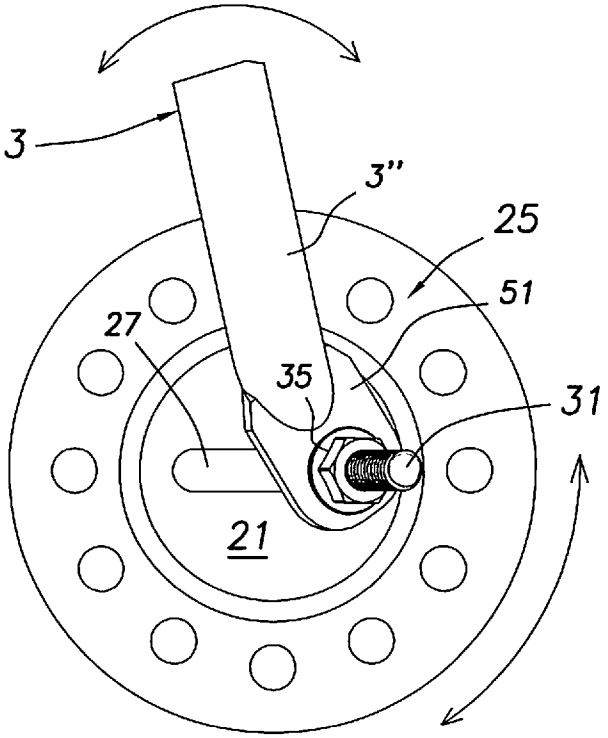
Figure 6E:
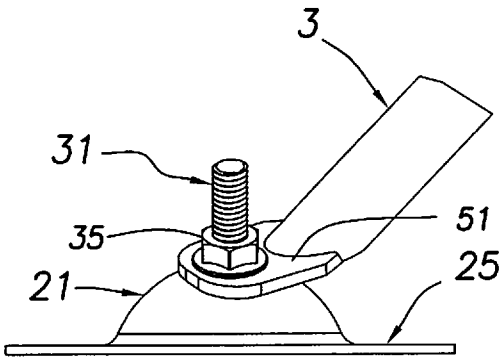
Figure 6D:
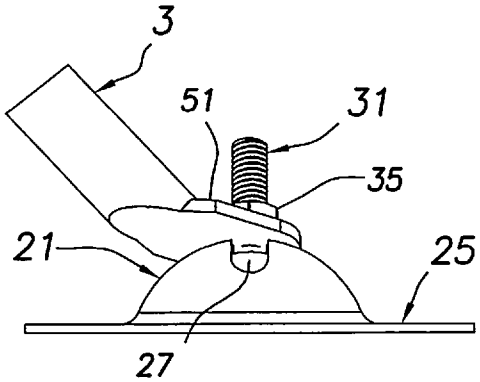
Figure 6C:
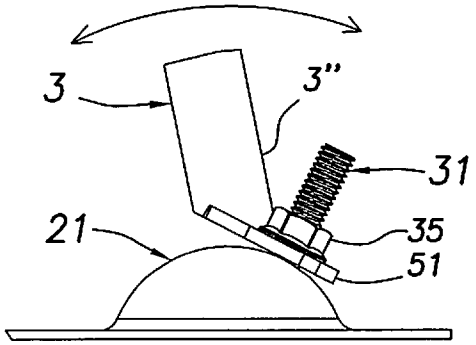
Figure 6F:
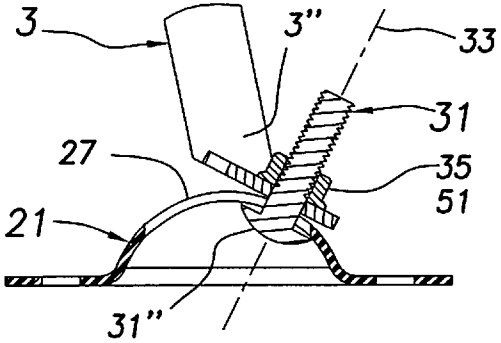

The multi-directional or positionable foot assembly 11 as illustrated in FIGS. 4*a*-4*b* as well as in FIGS. 5*a*-5*f* and 6*a*-6*e* includes a first, raised or dome-shaped portion 21 extending about an axis 23 (see FIGS. 5*a*-5*f*). The foot assembly 11 further preferably includes a second, preferably annular portion 25 extending outwardly of and about the raised portion 21. The raised or domed portion 21 (see again FIGS. 5*a*-5*f*) has a slot 27 through it that extends (e.g., 70-90 degrees) substantially along a substantially arcuate path substantially intersecting the axis 23 of the raised portion 21. The raised portion 21 can have any number of shapes including the substantially spherical section of FIGS. 4*a*-6*f*. The raised portion 21 can also extend only partially about the axis 23 if desired. Similarly, the second portion 25 can have any number of shapes (e.g., annular as shown as well as square, hexangular, or triangular) and can also extend only partially about the axis 23 and raised portion 21 if desired.

The raised or central portion 21 of the foot assembly 11 has upper and lower sides facing away from each other and the plane 29 (see FIGS. 5*c* and 5*e*) which is substantially perpendicular to the axis 23. The foot assembly 11 further includes an attaching member such as the carriage bolt 31 in FIGS. 4*a*-4*b* and 6*a*-6*f*. The attaching member 31 extends along an axis 33 between first and second end sections 31',31" (FIG. 4*b*) with the first end section 31' of the attaching member 31 being receivable in the slot 27 in the raised portion 21 in a direction away from the upper or top side of the raised portion 21. The first end section 31' of the attaching member 31 is also movable along the arcuate slot 27 in a plane containing the axis 23 and substantially perpendicular to the plane 29 of the annular portion 25. The lower or head section 31" of the attaching member 31 in this regard is sized to abut and be retained by the tightened nut 35 in FIG. 6*f* against the lower or underside of the raised portion 21 and not pass through the slot 27. The first end section 31' of the attaching member 31 is then adjustably securable in a fixed position to the second or lower end portion 3" of the leg 3.

This installation step can be accomplished (see FIGS. 4*a*-4*b* and 6*a*-6*f*) by positioning the leg 3 and attaching member 31 as desired and then tightening the nut 35 in place. The raised portion 21 in turn can already be fixedly secured to the support structure at this point or thereafter. Similarly, the first or upper end portions 3',5' of the legs 3,5 (see FIGS. 3*a*-3*b* and 7*a*-7*d*) are respectively adjustably securable in respective fixed positions to the third or mast leg 7. This can be done in a number of ways including by the illustrated clamp assembly of collar members 41 in FIGS. 7*a*-7*d* and the securing bolts 43 and nuts 45 (see FIG. 7*c*). Once the parts of the antenna mount 1 are so assembled and secured in place, the antenna mount 1 creates a rigid and fixed connection between the support structure (e.g., 2, 4, 6, and 8 of FIGS. 1*a*-3*b*) and the third or mast leg 7.

Figure 7B:
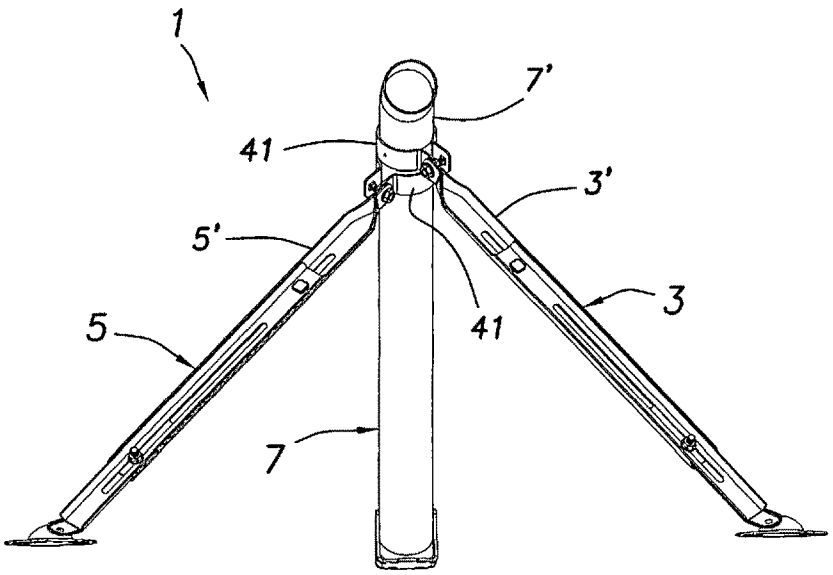
FIGS. 7*a*-7*d* are views of the antenna mount and in particular one manner in which the three legs of the antenna mount can be affixed to each other.
Figure 7A:
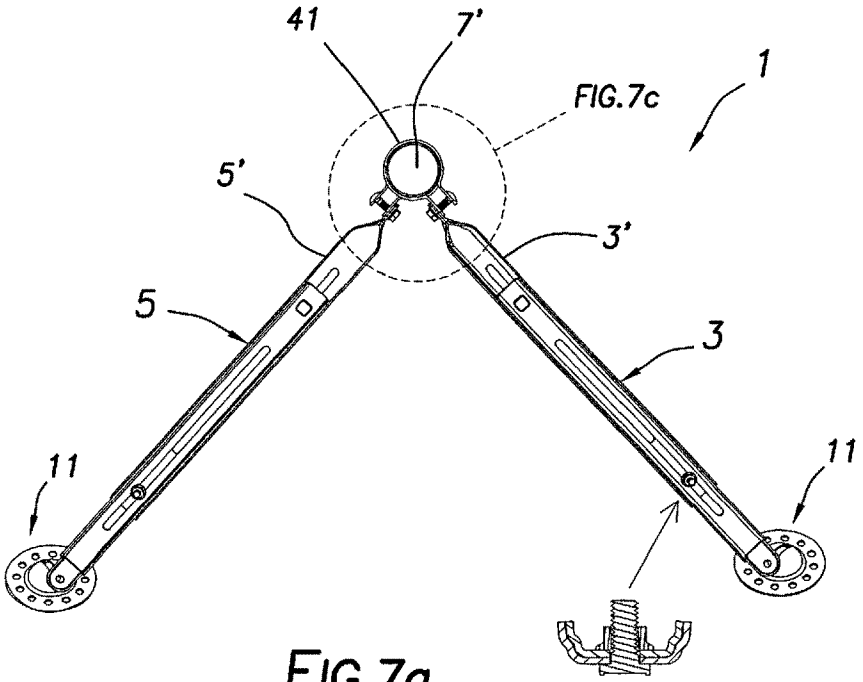
Figure 7C:
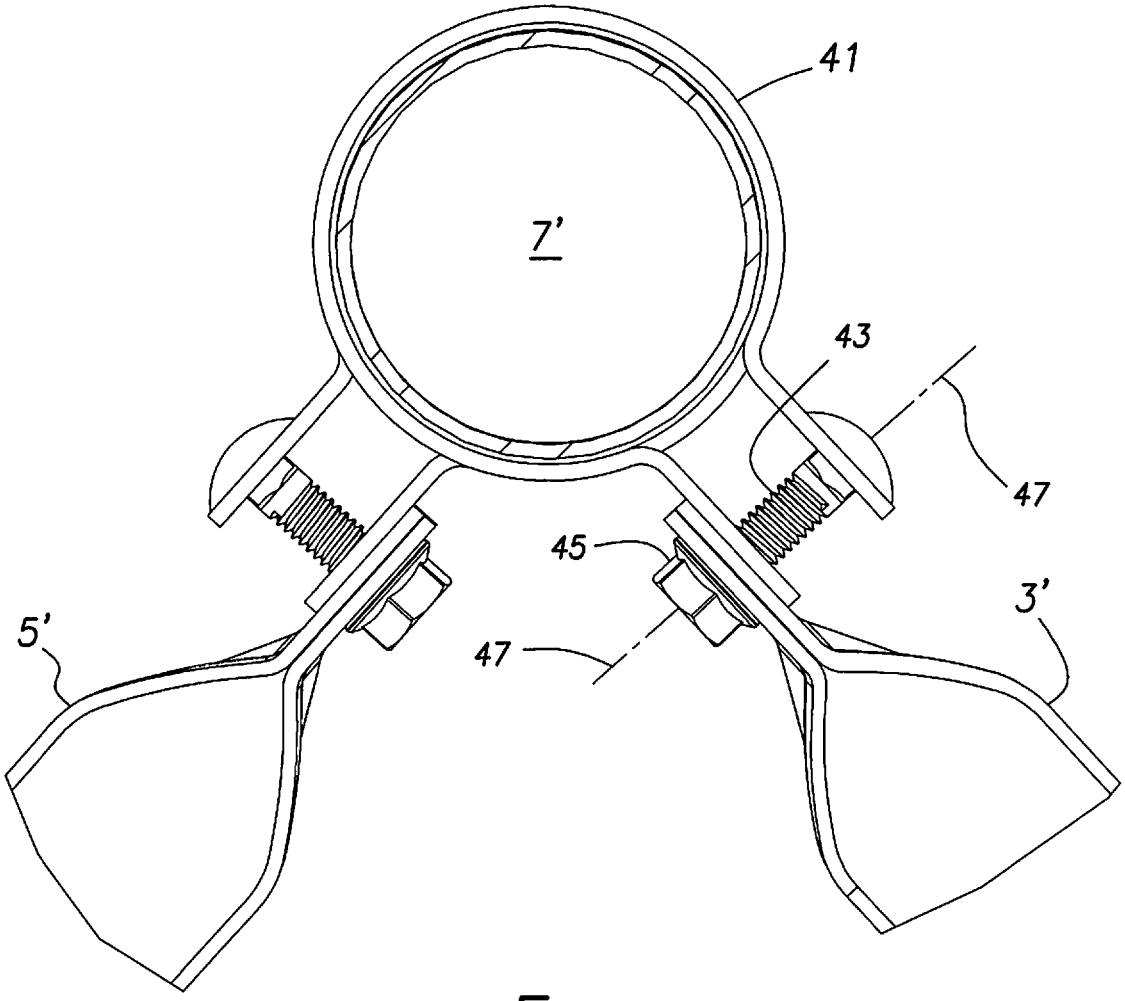
Figure 7D:
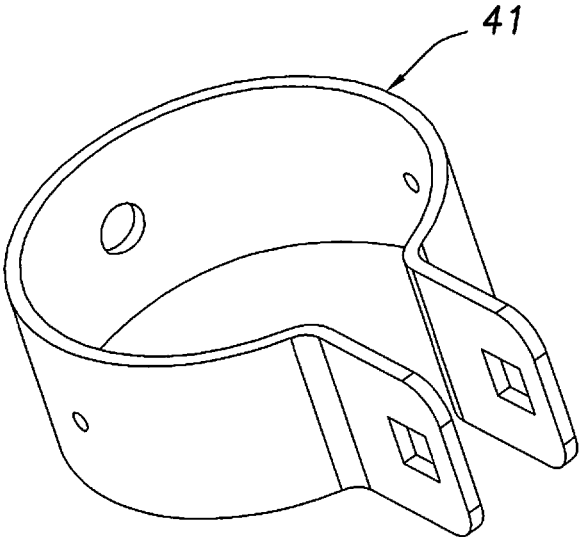
Figure 8A:
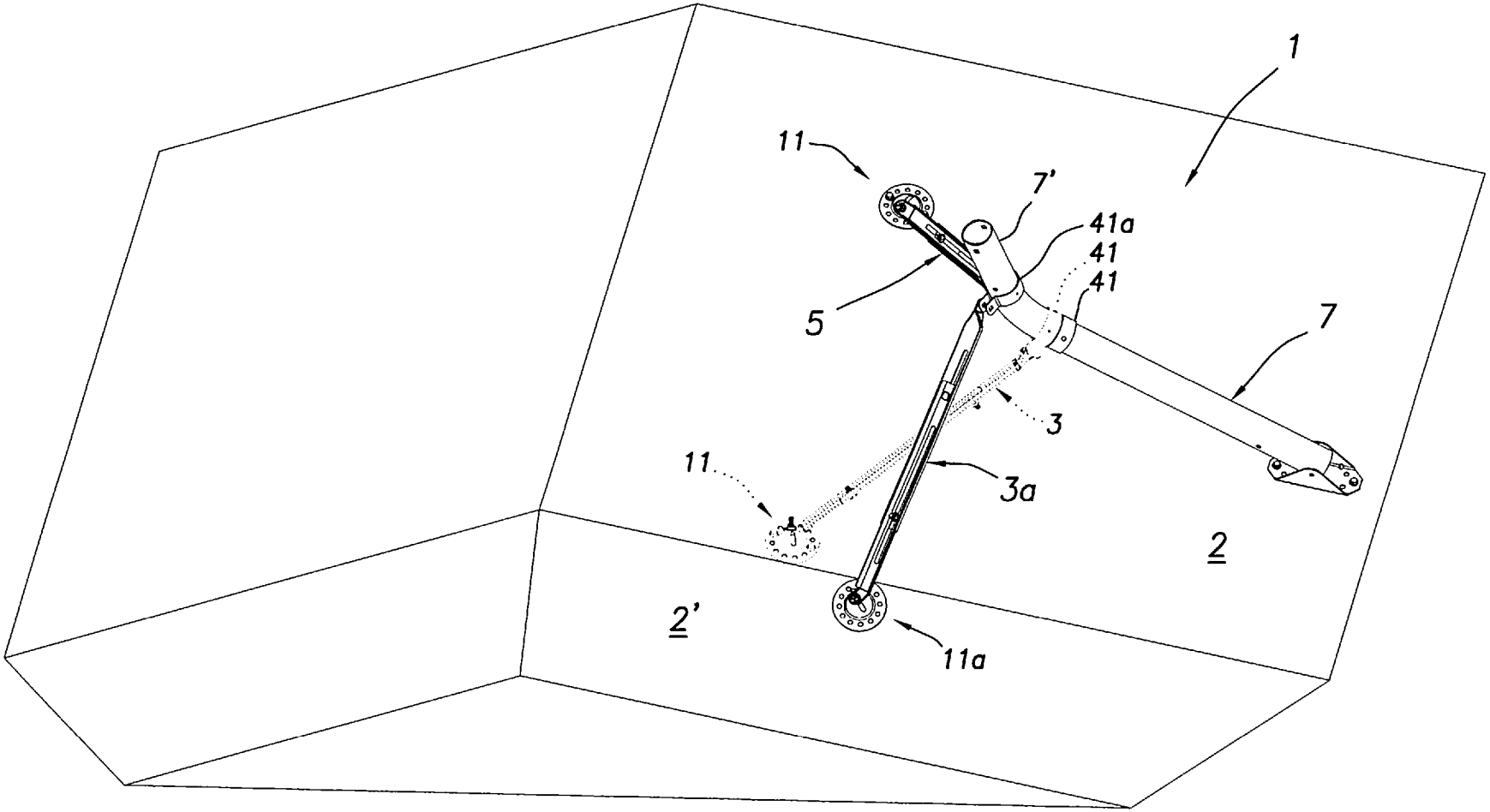
FIG. 8*a*-8*c* are view similar to FIGS. 1*a*-1*e* further illustrating the ability of the multi-directional foot assembly to accommodate and be secured to a variety of differently oriented support structures and surfaces such as found in a compound roof. The antenna element is not shown in these views for clarity.
Figure 8B:
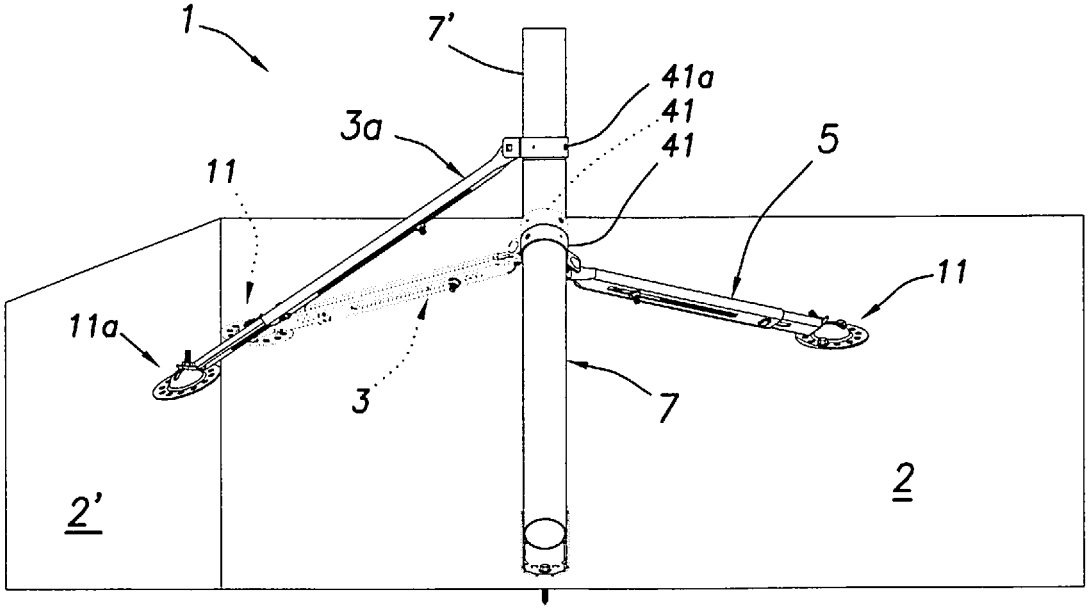
Figure 8C:
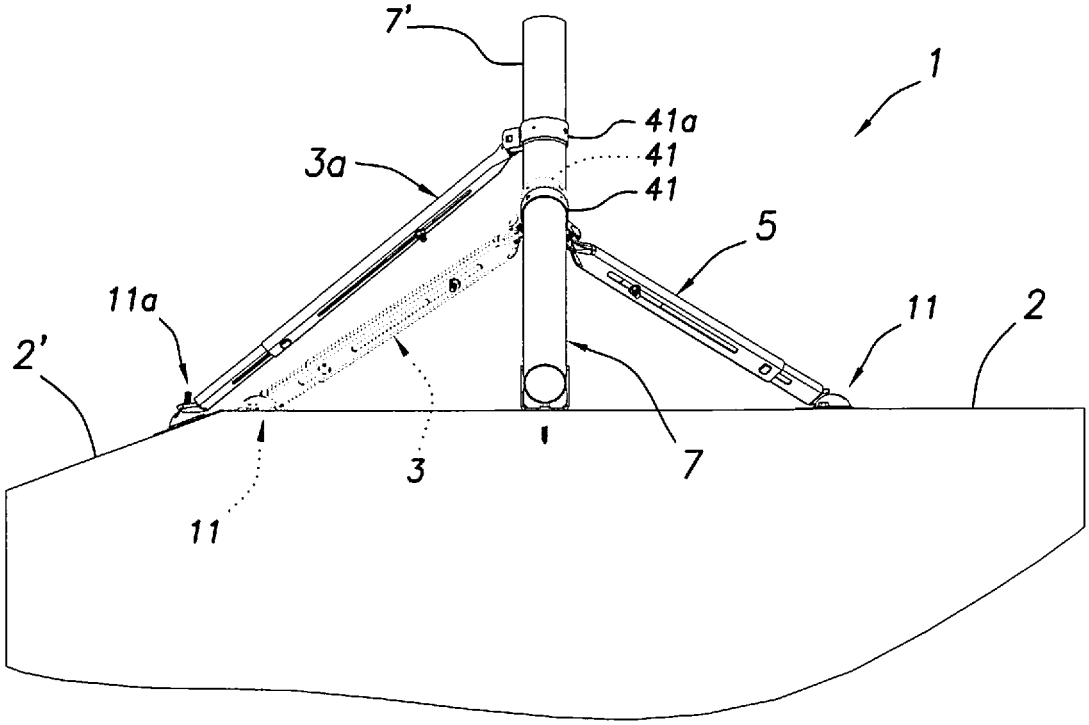

As illustrated in FIGS. 7*a*-8*c* and for additional flexibility and versatility in affixing the antenna mount 1 to a wide variety of support structure surfaces, the attaching collar members 41 adjustably securing the upper end portions 3',5' of the legs 3,5 to the mast leg 7 are preferably movable or slidable along the mast leg 7 (compare the grayed or dotted position of leg 3 and its collar member 41 in FIGS. 8*a*-8*c* to the adjusted position of 3*a* and 4*a* in these FIGS. 8*a*-8*c*). The collar members 41 are also rotatable about the mast leg 7. Further, the foot assembly 11 of each leg (e.g., 3 in FIGS. 8*a*-8*c*) is adjustably securable at 11*a* to a surface (e.g., 2') not in the plane of the surface 2. The surface 2' is also not in the plane of the other foot assembly 11 of the other leg 5 or in that of the mount 15 of the mast leg 7. Such differing surfaces like 2 and 2' can often be encountered in support structures such as compound roofs. Additionally enhancing this flexibility and versatility as shown in FIGS. 7*a*-7*b* and the enlarged views of 4*a*-4*b*, the legs 3 and 5 can be telescoping if desired.

The upper end portions 3',5' of the legs 3,5 are also preferably pivotally mounted to the respective collar members 41 (e.g., by bolt or other pivot member 43 in FIG. 7*c*) for movement about the axis 47 in addition to being slidable with the collar members 41 along the mast leg 7 as in FIGS. 8*a*-8*c* and rotatable therewith about the mast leg 7. The collar members 41, mast leg 7, and upper end portions 3',5' of the legs 3,5 can then all be fixed in the desired relationships when nuts 45 in FIG. 7*c* are tightened on the bolts 43. The lower end portions 3",5" of the legs 3,5 as best seen in FIGS. 4*a*-4*b* and 6*a*-6*f* also preferably have a substantially planar extension 51. The extension 51 as shown is preferably angled or inclined (e.g., 25-45 degrees) outwardly relative to the longitudinal axes (e.g., axis 23 of leg 3 in FIGS. 4*a*-4*b* and 6*b*) of the respective legs 3,5 and substantially tangent (FIG. 6*f*) to the raised dome portion 21 of the foot assembly 21. The extension 51 has a hole to receive the attaching member 31 and allows the legs 3,5 to be rotated 360 degrees about the bolt axis 33 of the attaching member 31. In this manner, the respective legs 3,5 can assume virtually any position about the axis 33 relative to the attaching member 31 which in turn can assume virtually any number of relative positions along the arcuate slot 27 of the raised portion 21 of the foot assembly 11. Additionally, the upper and lower sections 7',7" of the mast leg 7 can also be reversed if desired with the shorter section 7' being secured to the support structure and the longer section 7" positioned vertically to receive the antenna element 13.

The raised or dome-shaped portion 21 of the foot assembly 11 and the surrounding annular portion 25 in FIGS. 5*a*-5*f* are preferably an integral, one-piece member (e.g., metal or plastic) for ease and low cost of manufacture and installation. The annular portion 25 can also have a variety of hole shapes (see FIGS. 5*a* and 5*f*) to receive the securing members (e.g., lag or wood screws 53 in FIG. 4*a*) that fixedly secure the foot assembly 11 to the support structure such as 2 in FIG. 4*a*. Also for ease of installation, the attaching member 31 (e.g., carriage bolt) has a section 55 in FIG. 4*b* sized and shaped (e.g., square or hexagonal) to be received in the slot 27 of the raised portion 21 in a substantially abutting relationship. The section 55 then prevents rotation of the bolt 31 about its axis 33 relative to the slot 27 and raised portion 21 so the nut 55 can be tightened in place as in FIG. 6*f*.

It is noted that although the foot assembly 11 is shown in its preferred application in an antenna mount, it has equal utility in any environment in which multi-directional or positional attachment of a leg, strut, or other member to a second member or support in a plurality of fixed positions relative to each other is intended or desirable.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims. In particular, it is noted that the word substantially is utilized herein to represent the inherent degree of uncertainty that may be attributed to any quantitative comparison, value, measurement or other representation. This term is also utilized herein to represent the degree by which a quantitative representation may vary from a stated reference without resulting in a change in the basic function of the subject matter involved.

We claim:

1. An adjustable antenna mount (1) having a plurality of legs (3,5,7) wherein at least one (3) of the legs extends between first and second end portions (3',3") with said first end portion (3') being adjustably securable to another (7) of said legs and said second end portion (3") being adjustably securable to a multi-directional foot assembly (11) adjustably securable to a support structure, said multi-directional foot assembly (11) having a raised portion (21) extending at least in part about a first axis (23), said raised portion having a slot (27) therethrough extending substantially along a substantially arcuate path substantially intersecting said first axis (23), said raised portion (21) having upper and lower sides facing away from each other and said foot assembly further including an attaching member (31) extending along a second axis (33) between first and second end sections (31',31"), said first end section (31') being receivable through said slot (27) in a direction away from the upper side of the raised portion (21) and being movable along said slot with said second end section (31") of the attaching member (31) being sized to abut and be retained against the underside of the raised portion (21) and not pass through said slot (27), said first end section (31') of said attaching member being securable to the second end portion (3") of said one leg (3) in a fixed position relative to the second end portion (3") of the one leg and to said raised portion (21) of the foot assembly and said raised portion (21) being securable to said support structure in a fixed position relative thereto, said second end portion (3") of the one leg (3) being securable to said another leg (7) in a fixed position relative thereto to create a rigid and fixed connection between the support structure and said another leg (7).

2. The antenna mount of claim 1 further including an antenna element (13) removably securable to said another leg (7).

3. The antenna mount of claim 1 wherein said foot assembly further includes another portion (25) extending at least in part about said raised portion (21) and said first axis (23) and being fixed to said raised portion, said second portion being fixedly securable to said support structure to secure said raised portion to said support structure in said fixed position of said raised portion relative to said support structure.

4. The antenna mount of claim 3 wherein said raised portion (21) extends away from a plane (29) and said another portion (25) of the foot assembly extends outwardly of said raised portion substantially in said plane (29) and substantially perpendicular to said first axis (23).

5. The antenna mount of claim 4 wherein said another portion (25) of said foot assembly extends substantially about said raised portion and said first axis in said plane.

6. The antenna mount of claim 3 wherein said raised portion and said another portion of the foot assembly form an integral, one-piece member.

7. The antenna mount of claim 1 wherein said raised portion is substantially dome-shaped.

8. The antenna mount of claim 1 wherein said another leg (7) has an upper section (7') extending along a third axis (19) and a lower section (7") wherein said rigid and fixed connection between the support structure and said another leg (7) positions the third axis (19) of said upper section of said another leg substantially vertically.

9. The antenna mount of claim 8 wherein said lower section (7") of said another leg has a foot mount (15) fixedly securable to said support structure.

10. The antenna mount of claim 9 wherein said lower section (7") of said another leg is pivotally secured to said foot mount (15) thereof for movement about a pivotal axis (17).

11. The antenna mount of claim 10 wherein said pivotal axis is substantially horizontal with said foot mount fixedly secured to said support structure.

12. The antenna mount of claim 8 wherein said upper section (7') of said another leg is mounted to said support structure for movement in a plane containing said third axis (19).

13. The antenna mount of claim 8 wherein the lower section (7") of said another leg extends along a fourth axis (21) inclined to said third axis (19) and substantially intersecting the third axis and is fixedly securable to said support structure.

14. The antenna mount of claim 13 wherein said lower section (7") of said another leg is mounted to said support structure for movement in a plane containing said fourth axis (21).

15. The antenna mount of claim 8 wherein said another leg (7) is a tubular, mast and said antenna mount has an antenna element (13) removably securable to the upper section (7') of said another leg.

16. The antenna mount of claim 15 further including an additional leg (5) extending between said support structure and said another leg (7).

17. The antenna mount of claim 1 wherein said first end portion (3') of said one leg is adjustably securable to said another leg (7) in at least two positions relative to said another leg.

18. The antenna mount of claim 1 wherein said another leg has a section (7') extending along a third axis and said first end portion (3') of said one leg is adjustably securable to said section (7') of the another leg for rotational moment about said third axis and pivotal movement relative to said third axis.

19. The antenna mount of claim 18 further including a collar member (41) positionable about said section (7') of the another leg and slidable along said section and said third axis, said one leg (3) being adjustably securable to said another leg (7).

20. The antenna mount of claim 19 further including a pivot member (43) mounting the first end portion (3') of the one leg to said collar member for movement relative thereto about a pivotal axis (45).

21. The antenna mount of claim 1 wherein said one leg extends along a third axis (23) and has at least two telescoping sections for adjusting the length of said one leg along said third axis (23).

22. The antenna mount of claim 1 wherein said one leg extends along a third axis (23) and said second end portion (3") thereof includes a substantially planar member (51) inclined outwardly of said third axis (23) and having a hole therethrough to receive the first end section (31') of the attaching member therein.

23. The antenna mount of claim 22 wherein said planar member (51) is securable substantially tangentially to the raised portion (21) of the foot assembly.

24. The antenna mount of claim 1 wherein said attaching member further includes a section (55) receivable in said slot (27) of said raised portion of the foot assembly and sized and shaped to prevent rotation of said attaching member (31) about said second axis (33) relative to said slot (27).

25. A multi-directional foot assembly for adjustably securing a first member to a support structure in a plurality of positions relative to each other, said foot assembly having a raised portion extending at least in part about a first axis, said raised portion having a slot therethrough extending substantially along a substantially arcuate path substantially intersecting said first axis, said raised portion further having upper and lower sides facing away from each other and said foot assembly further including an attaching member extending along a second axis between first and second end sections, said first end section being receivable through said slot in a direction away from the upper side of the raised portion and being movable along said slot with said second end section of the attaching member being sized to abut and be retained against the underside of the raised portion and not pass through said slot, said first end section of said attaching member being securable to the first member in a fixed position relative thereto and to said raised portion of the foot assembly and said raised portion being securable to said support structure in a fixed position relative thereto to create a rigid and fixed connection between the support structure and said first member.

26. A multi-directional foot assembly of claim 25 wherein said foot assembly further includes another portion extending at least in part about said raised portion and said first axis and being fixed to said raised portion, said second portion being fixedly securable to said support structure to secure said raised portion to said support structure in said fixed position of said raised portion relative to said support structure.

27. The multi-directional foot assembly of claim 26 wherein said raised portion extends away from a plane and said another portion of the foot assembly extends outwardly of said raised portion substantially in said plane and substantially perpendicular to said first axis.

28. The multi-directional foot assembly of claim 27 wherein said another portion of said foot assembly extends substantially about said raised portion and said first axis in said plane.

29. The multi-directional foot assembly of claim 26 wherein said raised portion and said another portion of the foot assembly form an integral, one-piece member.

30. The multi-directional foot assembly of claim 25 wherein said raised portion is substantially dome-shaped.

31. The multi-directional foot assembly of claim 25 wherein first member extends along a second axis and includes a substantially planar member inclined outwardly of said second axis and having a hole therethrough to receive the first end section of the attaching member therein.

32. The multi-directional foot assembly of claim 25 wherein said attaching member further includes a section receivable in said slot of said raised portion of the foot assembly and sized and shaped to prevent rotation of said attaching member about said second axis relative to said slot.

* * * * *